US008602490B2

(12) United States Patent
Tsai et al.

(10) Patent No.: US 8,602,490 B2
(45) Date of Patent: Dec. 10, 2013

(54) HIGHCHAIR WITH ADAPTER FOR ATTACHING A CAR SEAT

(75) Inventors: Denny Tsai, Chino Hills, CA (US); Jung Tsai Chen, Tainan (TW)

(73) Assignee: Baby Trend Inc., Ontario, CA (US)

( * ) Notice: Subject to any disclaimer, the term of this patent is extended or adjusted under 35 U.S.C. 154(b) by 411 days.

(21) Appl. No.: 12/900,942

(22) Filed: Oct. 8, 2010

(65) Prior Publication Data

US 2012/0086240 A1 Apr. 12, 2012

(51) Int. Cl.
*A47C 13/00* (2006.01)

(52) U.S. Cl.
USPC ..... 297/130

(58) Field of Classification Search
USPC ..... 297/256.16, 130, 463.1, 463.2, 440.1, 297/440.22, 440.15, 251, 252, 134, 151, 297/148
See application file for complete search history.

(56) References Cited

U.S. PATENT DOCUMENTS

| | | | | |
|---|---|---|---|---|
| 3,427,069 | A * | 2/1969 | McDonald | 297/153 |
| 3,542,419 | A * | 11/1970 | Ercole | 297/130 |
| 4,065,175 | A * | 12/1977 | Perego | 297/130 |
| 2011/0181084 | A1 * | 7/2011 | Arnold et al. | 297/256.16 |

* cited by examiner

*Primary Examiner* — Milton Nelson, Jr.
(74) *Attorney, Agent, or Firm* — Chen Yoshimura LLP

(57) ABSTRACT

A baby highchair for detachably adapting an infant car seat. The highchair has a frame structure and a seat having a bottom and two opposite sidewalls each having two indents, and a car seat adapter bar detachably mounted to the seat between the two opposite sidewalls. The adapter bar has an elongated body with two opposite ends each having two pins, such that the pins at the opposite ends of the adapter bar can be respectively engaged with the indents on the opposite sidewalls of the seat of the highchair to securely attach the car seat adapter bar to the highchair. The elongated body of the car seat adapter bar has a contour for receiving the infant car seat such that the infant car seat can be secured to the adapter bar to adapt the car seat onto the highchair.

13 Claims, 8 Drawing Sheets

HIGHCHAIR WITH ADAPTER FOR ATTACHING A CAR SEAT

BACKGROUND OF THE INVENTION

1. Field of the Invention

This invention generally relates to a baby highchair, and in particular, it relates to a baby highchair with an adapter bar for attaching an infant car seat to the baby highchair.

2. Description of the Related Art

Child safety products such as highchairs, car seats and strollers are widely used by families with small children. There is an increasing trend of using multi-purpose products to fit different needs. For example, detachable infant car seats have been designed so that they can be used in the cars as infant car seats, but can also be used not in the cars as baby carriers. In this connection, some child strollers are also designed to receive infant car seats so that a small baby can use the car seat on the stroller. One example of such detachable car seat and stroller is disclosed in U.S. Pat. No. 7,040,694, which describes an infant car seat that can be attached to and detached from a car seat base and a stroller, where the stroller can be used with or without the infant car seat, and the car seat connects to the stroller frame through a bar that supports a tray at the front of the stroller.

Another example of a child support apparatus for use as a safety car seat, stroller, highchair and crib is disclosed U.S. Pat. No. 4,946,180, which describes a structure with telescoping legs, retractable wheels and pivotable handles.

It is desirable to provide a baby highchair that can receive a detachable infant car seat so that a detachable infant car seat can be readily and securely adapted to the baby highchair, allowing a small baby to use the car seat adapted to the highchair.

SUMMARY OF THE INVENTION

The present invention is directed to a baby highchair that has a car seat adapter bar for detachable attachment of an infant car seat to the highchair.

An object of the present invention is to provide a baby highchair that can be used in conjunction with an infant car seat.

Another object of the present invention is to provide an adapter bar for a baby highchair that can be used to detachably attach an infant car seat to the highchair.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a baby highchair for detachably adapting an infant car seat, comprising: a frame structure; a seat having a bottom and two opposite sidewalls each having at least one indent; a car seat adapter bar detachably mounted to the seat between the two opposite sidewalls, wherein the adapter bar has an elongated body with two opposite ends each having at least one pin, such that the pins at the opposite ends of the adapter bar can be respectively engaged with the indents on the opposite sidewalls of the seat of the highchair to securely attach the car seat adapter bar to the highchair; and the elongated body of the car seat adapter bar having a contour for receiving the infant car seat such that the infant car seat can be secured to the adapter bar to adapt the car seat onto the highchair.

In the exemplary embodiments of the baby highchair of the present invention, it further comprises a detachable seat back which can be mounted to the seat when no car seat is adapted to the highchair, or removed from the seat when the car seat is adapted onto the highchair.

In another aspect, the present invention provides a highchair for detachably adapting a child car seat, comprising: at least one structural element for detachably mounting a car seat adapter bar; the car seat adapter bar having a complementary structural element for detachably mounting onto the highchair; and the car seat adapter bar having a body configured for receiving the car seat such that the car seat can be secured to the adapter bar to adapt the car seat onto the highchair.

In yet another aspect, the present invention provides a car seat adapter bar for detachably adapting a child car seat to a highchair that has at least one structural element for detachably mounting the car seat adapter bar, comprising: a complementary structural element for detachably mounting onto the highchair; and a body configured for receiving the car seat such that the car seat can be secured to the adapter bar to adapt the car seat onto the highchair.

It is to be understood that both the foregoing general description and the following detailed description are exemplary and explanatory and are intended to provide further explanation of the invention as claimed.

DETAILED DESCRIPTION OF THE PREFERRED EMBODIMENTS

Embodiments of the present invention provide a baby highchair that has a car seat adapter bar for attachment of an infant car seat.

Figure 1:
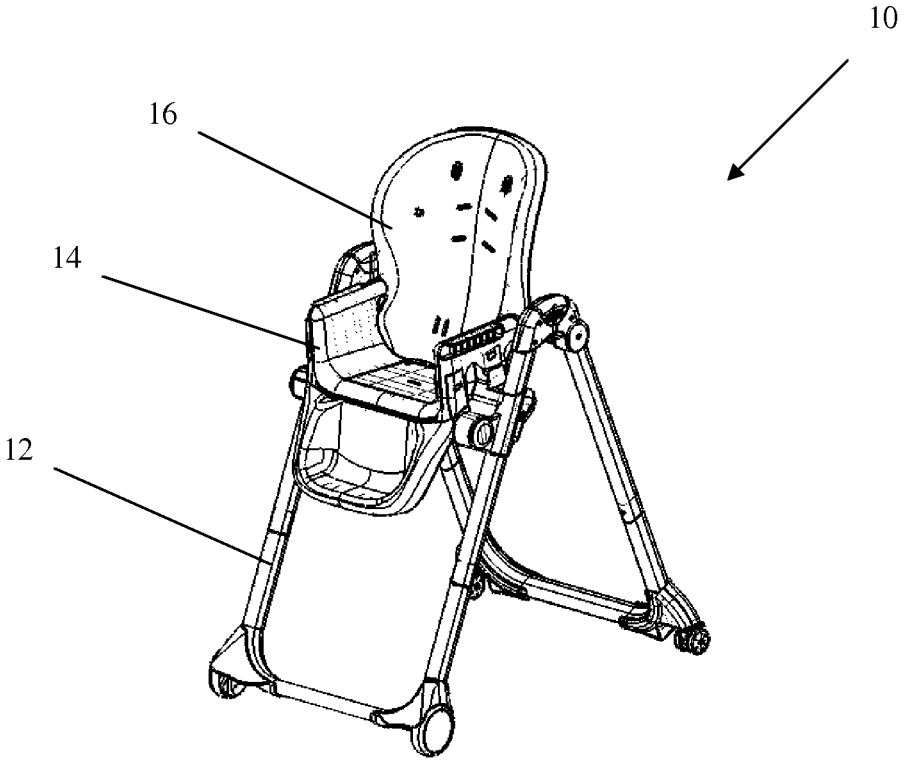
FIG. 1 is a perspective view showing a baby highchair that may be adapted to use with the car seat adapter bar according to an embodiment of the present invention.

Referring to FIG. 1, there is shown a baby highchair 10. The baby highchair 10 has a frame structure 12 to support a seat 14 on which a baby can be seated. The baby highchair also has a back 16 for supporting the baby back when the baby is seated in the highchair 10. For the purpose of the present invention, the seat back 16 can be a detachable seat back which can be removed and stored away when the highchair is used for adapting an infant car seat as described below.

Figure 2:
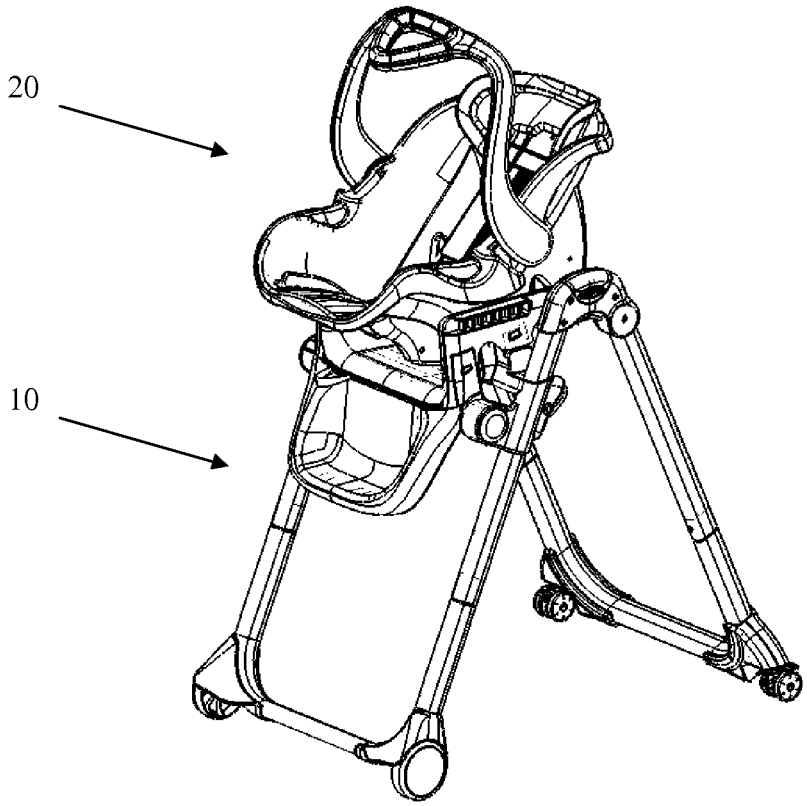
FIG. 2 is a perspective view showing a baby highchair with an infant car seat attached thereto according to an embodiment of the present invention.
Figure 3:
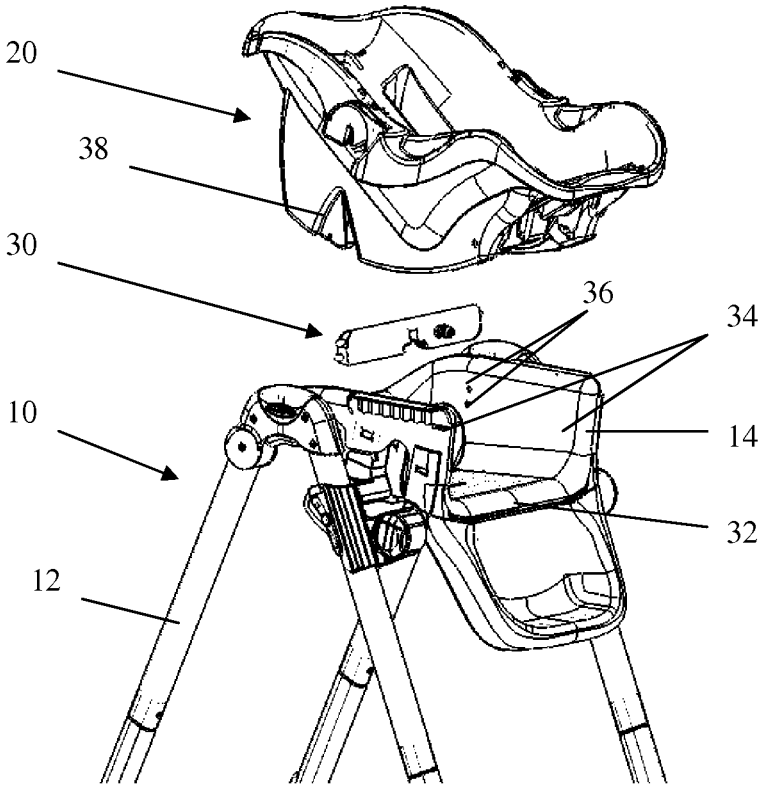
FIG. 3 is a partial exploded perspective view of the baby highchair of FIG. 1 with the infant car seat and car seat adapter bar shown as detached.

Referring to FIG. 2, the present invention baby highchair 10 can be used (when its seat back removed) for adapting an infant car seat 20. As shown in FIG. 3, the infant car seat 20 is attached to the baby highchair 10 with the help of a car seat adaptor bar 30.

Referring to FIG. 3, the seat 14 of the baby highchair 10 has a bottom 32 and two opposite sidewalls 34. Two vertically aligned indents or notches 36 are provided on the inside surface of each of the two opposite sidewalls 34 for detachably attaching the car seat adapter bar 30. The two indents 36 on one of the sidewalls 34 are horizontally aligned with the two indents 36 on the opposite one of the sidewalls 34, respectively, such that the car seat adapter bar 30 is leveled when it is attached to the sidewalls 34 of the seat 14 of the highchair 10. The infant car seat 20 typically has a bottom groove 38. When the car seat 20 is attached to the highchair 10, the car seat adapter bar 30 is positioned within the bottom groove 38 of the car seat 20 so that the car seat 20 can be securely attached to the highchair 10.

Figure 4:
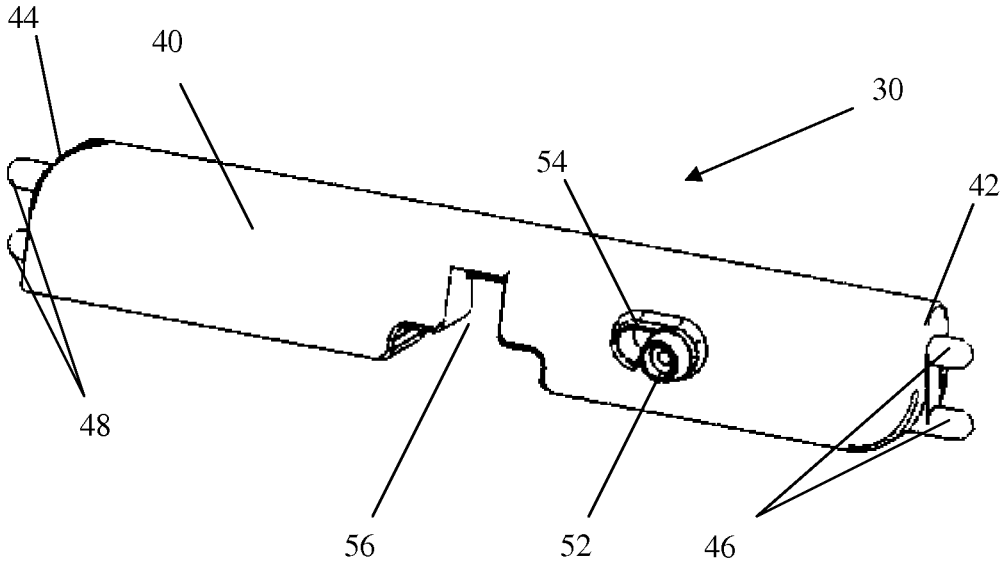
FIG. 4 is a perspective view of a car seat adapter bar according to one of the embodiments of the present invention.

Referring to FIG. 4, the car seat adapter bar 30 has an elongated contoured body 40 with two opposite ends 42 and 44. The length of the elongated body 40 of the car seat adapter bar 30 is about the same as the width of the seat 14 of the highchair 10. At one end 42 of the elongated body 40 of the car seat adapter bar 30 there are provided a set of two pins or pegs 46, and at the opposite end 44 of the elongated body 40 of the car seat adapter bar 30 there are also provided a set of two pins or pegs 48. The spacing and size of the pins 46 and 48 are designed to fit into the indents 36 of the sidewalls 34 of the seat 14 of the highchair 10, respectively. At least at one of the two opposite ends 42 and 44 of the elongated body 40 of the car seat adapter bar 30, the two pins are made movable for installation of the car seat adapter bar 30 onto the highchair 10.

In the embodiment shown in FIG. 4, the two pins 46 at the end 42 of the elongated body 40 of the car seat adapter bar 30 can be retracted inwardly by a button 52 which is connected to the two pins 46 through an internal chamber of the elongated body 40 of the car seat adapter bar 30. The button 52 protrudes out through a small opening 54 on the elongated body 40 of the car seat adapter bar 30 so that a user can hold the button 52 to move the pins 46. Alternatively, the two pins 46 may be engaged by an internal spring (not shown) so that when squeezed, they can retract inwardly but the spring force will bias them outwardly so that when they are aligned with the indents 36 respectively, they can protrude out to insert into the indents 36 respectively.

Figure 5:
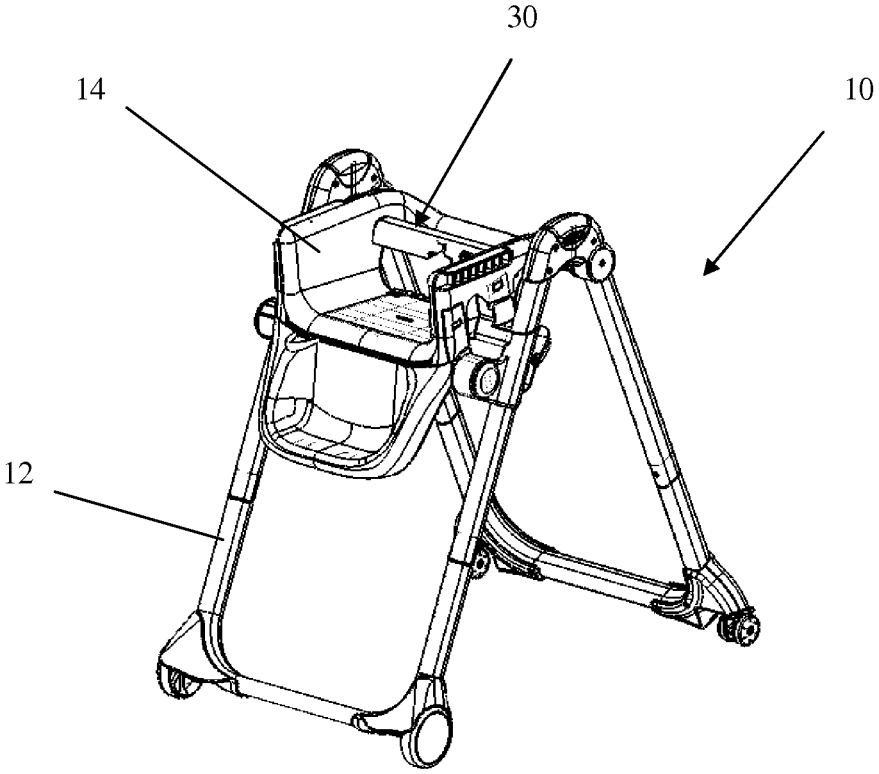
FIG. 5 is a perspective view showing the baby highchair of FIG. 1 with the car seat adapter bar attached thereto.
Figure 6:
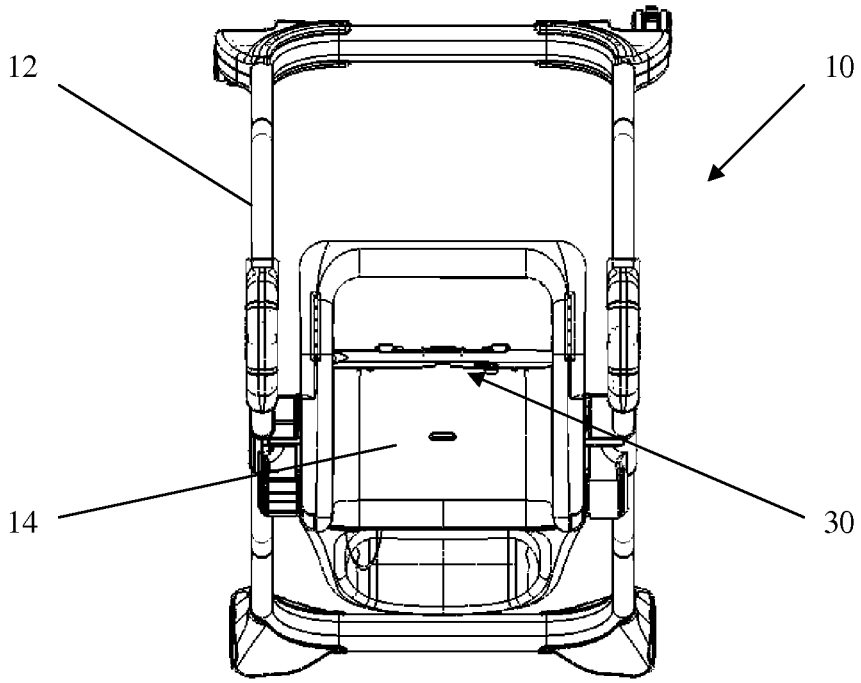
FIG. 6 is a top view of the baby highchair of FIG. 5 showing the car seat adapter bar attached to the highchair.

Referring to FIGS. 3 and 4, when installing the car seat adapter bar 30 onto the highchair 10, a user may first respectively insert the pins 48 at end 44 of the car seat adapter bar 30 into the indents 36 at one of the sidewalls 34 of the seat 14 of the highchair 10, and slide the button 52 on the car seat adapter bar 30 inwardly to retract the pins 46 at the end 42 of the car seat adapter bar 30, so that car seat adapter bar 30 can be moved into position (because of the tight fit of the length of the car seat adapter bar 30 and the width of the seat 14 of the highchair 10) with the two pins 46 aligned with the two indents 36 on the opposite sidewall 34 of the seat of the highchair 10. The user may then slide the button 52 on the car seat adapter bar 30 outwardly to extend the pins 46 at the end 42 of the car seat adapter bar 30, so that the two pins 46 can be respectively inserted into the two aligned indents 36 to securely attached the car seat adapter bar 30 to the highchair 10, as shown in FIGS. 5 and 6. If the car seat adapter bar 30 is to be removed from the highchair 10, the user may move the button 52 inwardly to disengaged pins 46 from the respective indents 36 on the sidewall 34 of the seat 14 of the highchair 10 to lift the car seat adapter bar 30 away from the highchair 10.

Referring to FIG. 4 again, the notch or open area 56 provided at the lower middle portion of the elongated body 40 of the car seat adapter bar 30 is designed to accommodate a latching or locking member (not shown) typically located at the bottom of an infant car seat which can engage and latch or lock onto the car seat adapter bar 30 to securely attach the car seat to the car seat adapter bar 30.

Figure 7:
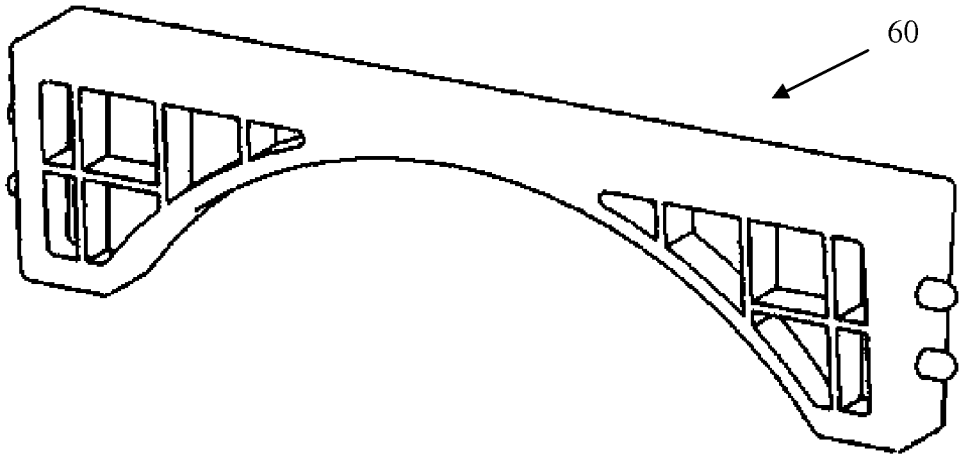
FIG. 7 is a perspective view of a car seat adapter according to another one of the embodiments of the present invention.
Figure 8:
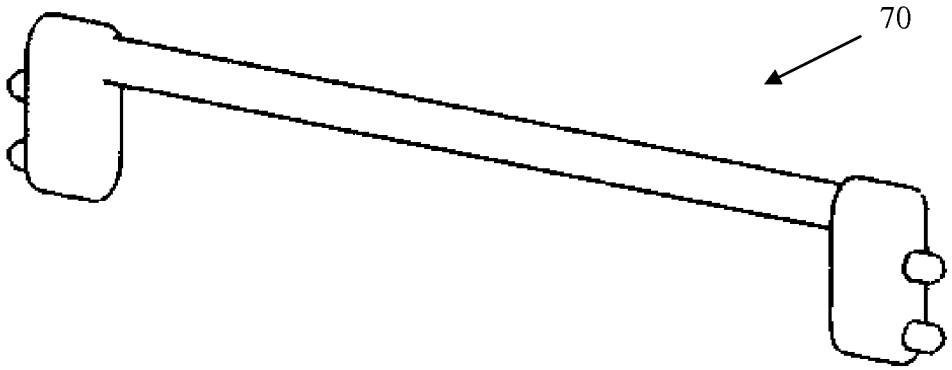
FIG. 8 is a perspective view of a car seat adapter according to still another one of the embodiments of the present invention.

Referring to FIGS. 7 and 8, there are shown at 60 and 70 alternative exemplary embodiments of the present invention car seat adapter bar. The key features of the car seat adapter bar 30, such as the end pins, are incorporated in these alternative embodiments. However, the body shape and contour of the car seat adapter bars in the alternative embodiments are modified to fit various infant car seats. It is understood that FIGS. 7 and 8 merely illustrate two possible alternative embodiments of the present invention car seat adapter bar and other body shapes and contours fitting various other infant car seats are also within the scope of the present invention.

It is also understood that the pins at the ends of the car seat adapter bar may be indents while the indents on the sidewalls of the seat of the highchair may be pins. It is further understood that other types of engagement, fastening or locking structures or mechanisms may be used in the place of the pins and indents.

The present invention highchair for detachably adapting an infant car seat has many advantages. It provides a baby highchair onto which an infant car seat can be quickly and easily attached. When the car seat is attached to the highchair, it is securely latched or locked to the car seat adapter bar so it will not fall off from the highchair. When desired, the car seat can be quickly and easily detached from the highchair and used as a baby carrier or baby car seat. The detachable seat back can be removed when a car seat is to be attached to the highchair, or installed back when a car seat attached to the highchair is removed therefrom to restore the highchair as a regular highchair.

It will be apparent to those skilled in the art that various modification and variations can be made in the present invention without departing from the spirit or scope of the invention. Thus, it is intended that the present invention cover modifications and variations that come within the scope of the appended claims and their equivalents.

What is claimed is:

1. A baby highchair for detachably adapting an infant car seat, comprising:

a frame structure;

a seat having a bottom and two opposite sidewalls each having at least one indent; and a car seat adapter bar detachably mounted to the seat between the two opposite sidewalls, wherein the adapter bar has an elongated body with two opposite ends each having at least one pin, such that the pins at the opposite ends of the adapter bar can be respectively engaged with the indents on the opposite sidewalls of the seat of the highchair to securely attach the car seat adapter bar to the highchair;

wherein the elongated body of the car seat adapter bar has a contour for receiving the infant car seat such that the infant car seat can be secured to the adapter bar to adapt the car seat onto the highchair.

2. The baby highchair of claim 1, wherein the elongated body of the car seat adapter has a length between the two opposite ends that is substantially the same as a width of the seat of the highchair at a location between the respective indents on the opposite sidewalls.

3. The baby highchair of claim 1, wherein the respective indents on the opposite sidewalls are horizontally aligned such that the car seat adapter bar is leveled when it is attached to the seat of the highchair.

4. The baby highchair of claim 1, wherein the at least one pin at one of the two opposite ends of the car adapter bar is retractable.

5. The baby highchair of claim 1, wherein the car seat adapter bar further comprises a button for moving the at least one retractable pin.

6. The baby highchair of claim 1, further comprising a detachable seat back which can be mounted to the seat when no car seat is adapted to the highchair, or removed from the seat when the car seat is adapted onto the highchair.

7. A car seat adapter bar for detachably adapting a child car seat to a highchair that has at least one structural element for detachably mounting the car seat adapter bar, comprising:

a body configured for receiving the car seat such that the car seat can be secured to the car seat adapter bar to adapt the car seat onto the highchair, the body having two opposite ends, at least two pins each located at one of the two opposite ends of the body for detachably mounting the car seat adapter bar onto the highchair, wherein at least one of the at least two pins is retractable; and a button for moving the at least one retractable pin.

8. A highchair for detachably adapting a child car seat, comprising:

a car seat adapter bar; and a seat having at least one structural element for detachably mounting the car seat adapter bar;

wherein the car seat adapter bar has a complementary structural element for detachably mounting onto the seat;

wherein the car seat adapter bar has a body configured for receiving the car seat such that the car seat can be secured to the adapter bar to adapt the car seat onto the highchair; and wherein the at least one structural element of the seat comprises at least two engagement features each located on one of two opposite sidewalls of the seat, and the complementary structural element of the car seat adapter bar comprises at least two complementary engagement features each located at one of two opposite ends of the car seat adapter bar.

9. The highchair of claim 8, wherein the at least two engagement features of the highchair are horizontally aligned such that the car seat adapter bar is leveled when it is attached to the seat of the highchair.

10. The highchair of claim 8, wherein the at least two engagement features of the highchair are indents, and the at least two complementary engagement features of the car seat adapter bar are pins.

11. The highchair of claim 10, wherein at least one pin at one of the two opposite ends of the car adapter bar is retractable.

12. The highchair of claim 11, wherein the car seat adapter bar further comprises a button for moving the at least one retractable pin.

13. The highchair of claim 8, further comprising a detachable seat back which can be mounted to the seat when no car seat is adapted to the highchair, or removed from the seat when the car seat is adapted onto the highchair.

* * * * *